US006299324B1

(12) United States Patent
Kim

(10) Patent No.: US 6,299,324 B1
(45) Date of Patent: Oct. 9, 2001

(54) MULTI-FUNCTION LANTERN INCLUDING FLASHING LANTERN CAP

(76) Inventor: Tae Hyung Kim, 2-702 sambo mansion, 580-4 yunsan 1 dong, yunjae-ku, Busan (KR), 611-081

( * ) Notice: Subject to any disclaimer, the term of this patent is extended or adjusted under 35 U.S.C. 154(b) by 0 days.

(21) Appl. No.: 09/508,525

(22) PCT Filed: Sep. 26, 1998

(86) PCT No.: PCT/KR98/00297

§ 371 Date: Mar. 27, 2000

§ 102(e) Date: Mar. 27, 2000

(87) PCT Pub. No.: WO99/17050

PCT Pub. Date: Apr. 8, 1999

(30) Foreign Application Priority Data

| | | |
|---|---|---|
| Sep. 26, 1997 | (KR) | 97-27462 |
| Oct. 2, 1997 | (KR) | 97-28055 |
| Nov. 25, 1997 | (KR) | 97-34246 |

(51) Int. Cl.[7] ..... F21L 7/00; F21V 33/00

(52) U.S. Cl. ..... 362/119; 362/186; 362/202; 362/205; 362/207; 362/102; 362/109; 362/96

(58) Field of Search ..... 362/186, 202, 362/203, 205, 207, 102, 109, 119, 120, 551, 577, 96

(56) References Cited

U.S. PATENT DOCUMENTS

| | | | |
|---|---|---|---|
| 2,092,664 | 9/1937 | Bray | 177/329 |
| 2,340,530 | 2/1944 | Hefner | 240/6 |
| 2,591,269 | 4/1952 | Lehoczki | 177/329 |
| 2,611,019 | 9/1952 | Warner | 177/329 |
| 3,197,757 | 7/1965 | Porta | 340/321 |
| 3,622,776 | 11/1971 | Wyrick | 240/10 |
| 4,208,701 | 6/1980 | Schock | 362/202 |
| 4,286,811 | 9/1981 | Schantz | 292/201 |
| 4,449,474 | 5/1984 | Mariol | 116/2 |
| 4,782,433 | 11/1988 | Rombough | 362/186 |
| 5,097,399 | 3/1992 | Gammache | 362/197 |
| 5,171,086 | 12/1992 | Baloochi | 362/188 |
| 5,307,249 | 4/1994 | Vanwynsberghe | 362/96 |
| 5,345,370 | 9/1994 | Murray et al. | 362/205 |
| 5,383,103 | 1/1995 | Pasch et al. | 362/102 |
| 5,440,465 | 8/1995 | Hasness | 362/191 |
| 5,446,985 | 9/1995 | Chen | 42/1 |
| 5,519,593 * | 5/1996 | Hasness | 362/186 |
| 5,642,931 * | 7/1997 | Gappelberg | 362/186 |

FOREIGN PATENT DOCUMENTS

| | | |
|---|---|---|
| 4445987 | 3/1996 | (DE) . |
| 0326769 | 8/1989 | (EP) . |
| 0632227 | 1/1995 | (EP) . |
| 2166860 | 5/1986 | (GB) . |
| 2267333 | 12/1993 | (GB) . |

* cited by examiner

*Primary Examiner*—Thomas M. Sember
(74) *Attorney, Agent, or Firm*—Jacobson Holman, PLLC

(57) ABSTRACT

A lantern having a flashing lantern cap includes a flashing lantern cap, a head, and a handle. The flashing lantern cap is formed to be capable of being detachable from the lantern to make light emitted from a lamp of the lantern to flash. The flashing lantern cap is attached at the fore end of the head. The head has the lamp inside and into which the flashing lantern cap is inserted. The handle is coupled to the rear end of the head and stores a battery inside. The handle can further include at the rear end thereof a multi-function portion having at least one of a cutter for cutting provided at an angled inlet, a hammer for breaking a car window, and a compressed gas injector used for self-defense.

14 Claims, 7 Drawing Sheets

MULTI-FUNCTION LANTERN INCLUDING FLASHING LANTERN CAP

This application is a 371 of PCT/KR 98/00297 filed on Sep. 26 1998

BACKGROUND OF THE INVENTION

1. Field of the Invention

The present invention relates to a lantern, and more particularly, to a multi-function lantern including a flashing lantern cap which can be used as a flashlight, a cutter, a hammer, and a compressed gas injector.

2. Description of the Prior Art

In general, a lantern is a portable illumination apparatus used to see in the dark places. FIG. 1 is a perspective view showing a conventional lantern. As shown in the drawing, a front cap 12 formed of transparent plastic material is coupled to a screw formed at an end of the lantern 100. Thus, the light emitted from the lantern 100 proceeds straight forward and simultaneously diverges outward by the front cap 12.

However, since the conventional lantern 100 must additionally include the front cap 12, it is inconvenient to keep and store the front cap 12 separately. Also, since the size of the front cap 12 attached to the lantern 100 is small, it is not appropriate to be used as a flashing lantern cap.

SUMMARY OF THE INVENTION

To solve the above problems, it is an objective of the present invention to provide a multi-purpose lantern having a flashing lantern cap kept inside and also having a hammer, a cutter, and a compressed gas injector at an opposite end thereof.

Accordingly, to achieve the above objective, there is provided a lantern having a flashing lantern cap which comprises a flashing lantern cap, formed to be capable of being detachable from the lantern, for making light emitted from a lamp of the lantern to flash, a head portion to which the flashing lantern cap is attached at the fore end thereof, having the lamp therein, and into which the flashing lantern cap is inserted and a handle portion coupled to the rear end of the head portion and having a battery inside.

It is preferable in the present invention that the handle portion further comprises, at the rear end thereof, a multi-function portion having at least one of a cutter for cutting provided at an angled inlet, a hammer for breaking a car window, and a compressed gas injector used for self-defense.

BRIEF DESCRIPTION OF THE DRAWINGS

The above objective and advantages of the present invention will become more apparent by describing in detail a preferred embodiment threof with reference to the attached drawings in which.

BEST MODE FOR CARRYING OUT THE INVENTION

Figure 1:
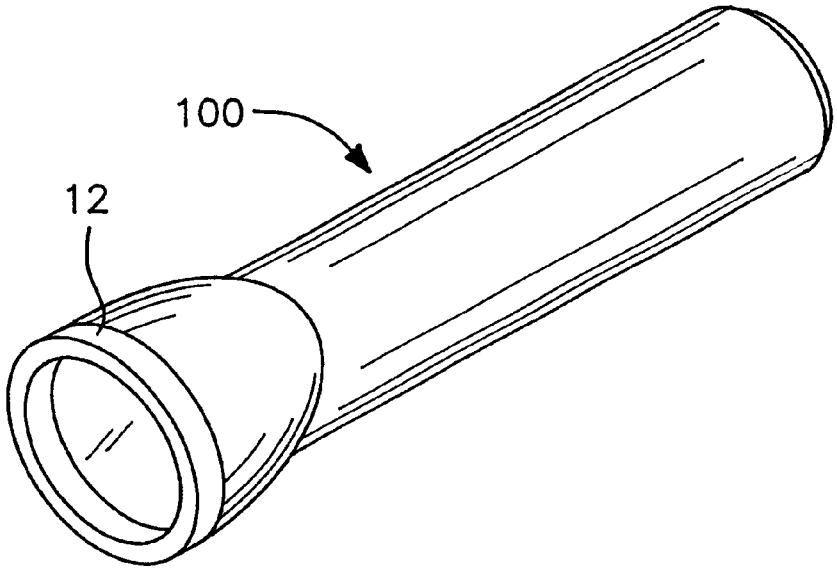
FIG. 1 (PRIOR ART)
FIG. 1 is a perspective view illustrating a conventional lantern.
Figure 2:
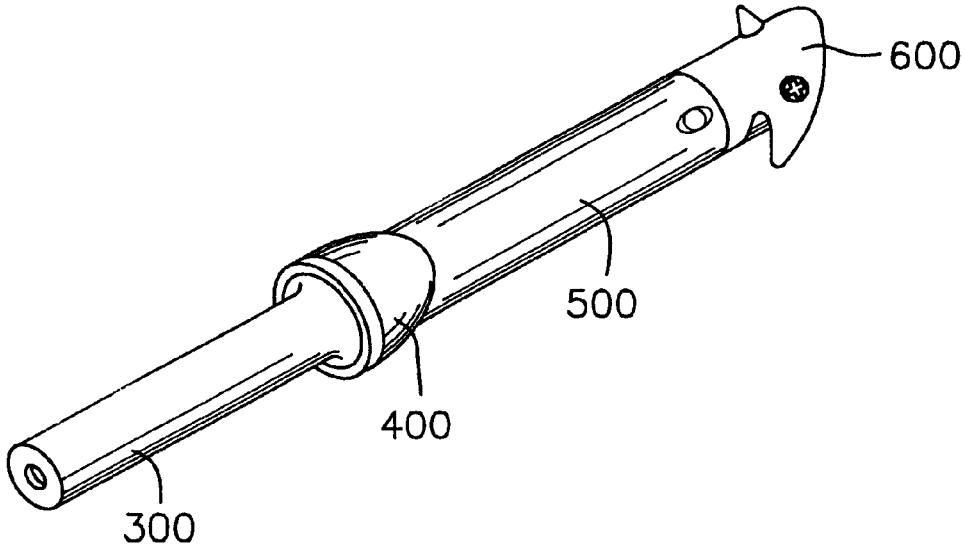
FIG. 2 is a perspective view illustrating a lantern with a flashing cap according to the present invention.

FIG. 2 shows a lantern including a flashing lantern cap according to the present invention. As shown in the drawing, the lantern including a flashing light cap includes a flashing lantern cap 300, a head portion 400, a handle portion 500, and a multi-function portion 600.

Figure 3A:
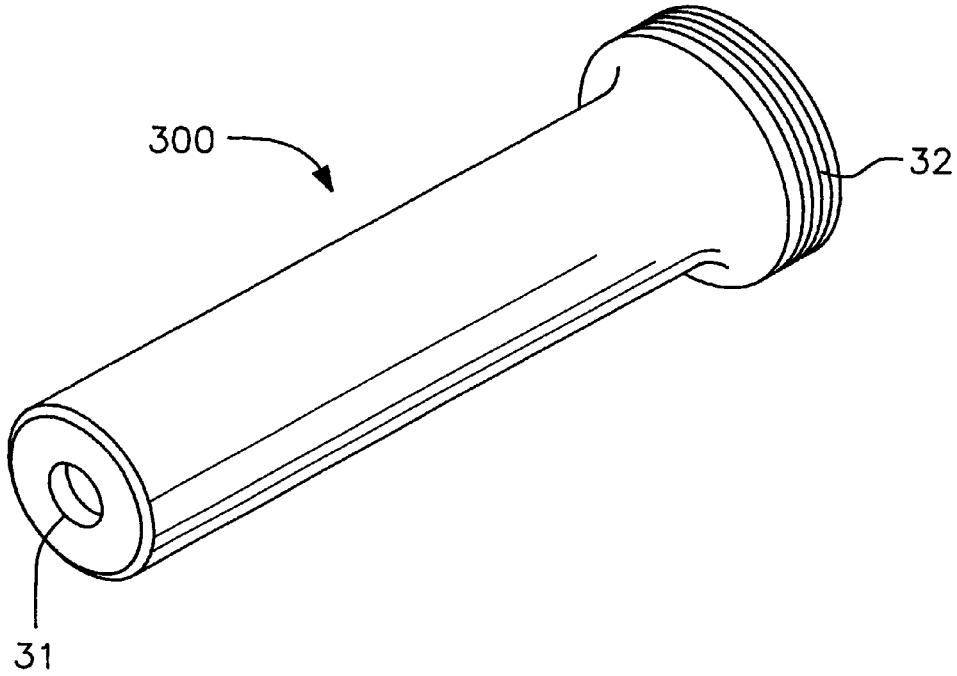
FIG. 3*a* is a perspective view illustrating in detail the flashing lantern cap of FIG. 2.

FIG. 3*a* shows the flashing lantern cap 300 in detail. As shown in the drawing, the flashing lantern cap 300 is a pipe and formed of red or white, semitransparent or transparent material. The flashing lantern cap 300 has a hole 31 at the fore end surface thereof and open screw-threaded portion 32 at the outer circumferential surface of the rear end thereof.

Figure 3B:
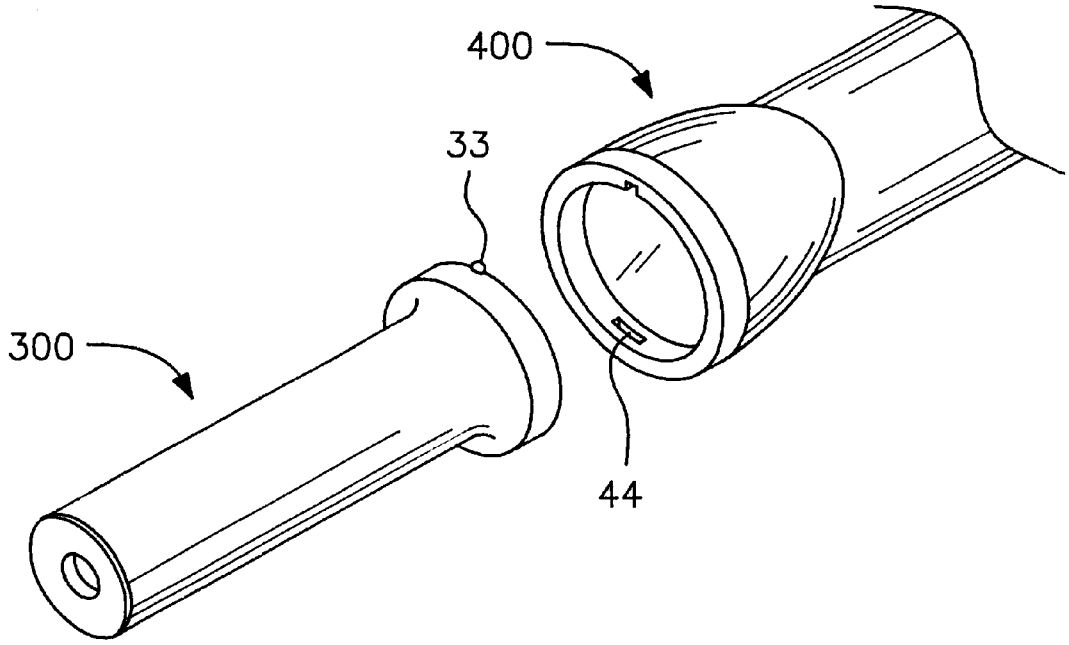
FIG. 3*b* is a view showing a flashing lantern cap according to another embodiment of the present invention.

FIG. 3*b* shows another embodiment of the flashing lantern cap 300. As shown in the drawing, a protrusion 33 is formed at opposing positions on the outer circumferential surface of the rear end of the flashing lantern cap 300. The protrusion 33 is inserted into grooves 44 formed at corresponding positions on the inner circumferential surface of the fore end of the head portion 400, so that the flashing lantern cap 300 and the head portion 400 are coupled together.

Figure 4:
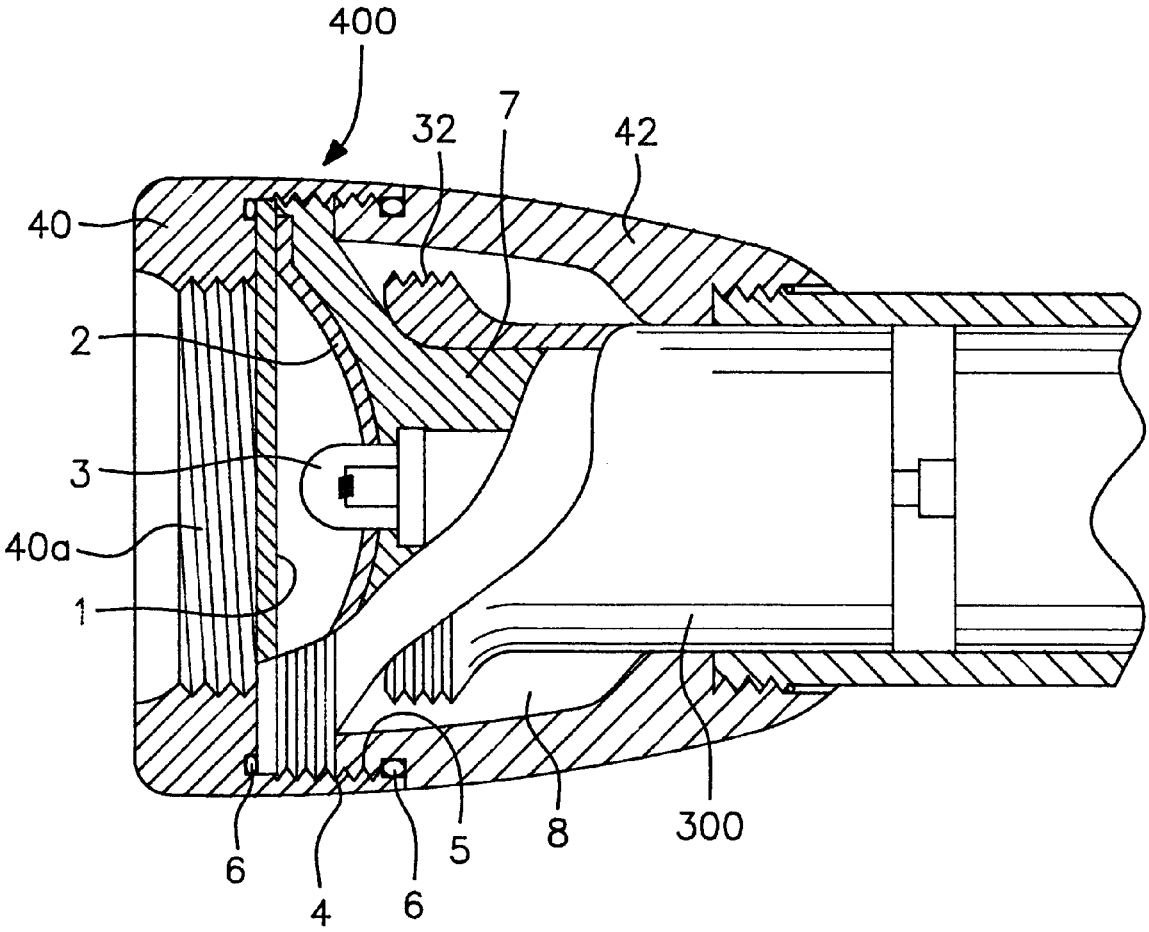
FIG. 4 is a sectional view showing a head portion of the lantern of FIG. in which the flashing lantern cap is kept.

FIG. 4 shows the head portion 400 in which the flashing lantern cap 300 is kept As shown in the drawing, the head portion 400 comprises a cap portion 40 and a body portion 42. The body portion 42 includes a transparent window 1, a reflection mirror 2 of a funnel shape installed inside the body portion 42, a lamp 3 positioned at the center of the reflection mirror 2, and a lamp socket 7 for housing and supporting the lamp 3 and electrically connecting to the lamp 3. Here, reference numeral 8 represents a space formed between the lamp socket 7 and the body portion 42.

The outer circumferential surface of the rear end of the flashing lantern cap 300 where the screw-threaded portion 32 is formed, as shown in FIG. 3*a*, is coupled to a screw-threaded portion 40*a* formed on the inner circumferential surface of the fore end of the cap portion 40 shown in FIG. 4.

Also, as a screw-threaded portion 4 is formed on the inner circumferential surface of the rear end of the cap portion 40 and a screw-threaded portion 5 is formed on the outer circumferential surface of the fore end of the body portion 42, the screw-threaded portions 4 and 5 are conjoined such that the cap portion 40 and the body portion 42 are coupled to one another. Further, in order to prevent intrusion of the moisture or water from the outside, an O-ring 6 is provided between the cap portion 40 and the body portion 42.

The flashing lantern cap 300 not in use is kept in the space 8 formed between the lamp socket 7 and the body portion 42. When the cap portion 40 is detached from the body portion 42 to insert the flashing lantern cap 300, the transparent window 1, the reflection mirror 2, and the lamp socket 7 coupled to the cap portion 40 are detached from the body portion 42. Then, the fore end of the flashing lantern cap 300 is inserted into the space 8 of the head portion 400. Then the cap portion 40 having the transparent window 1, the reflection mirror 2, and the lamp socket 7 is coupled to the body portion 42 so that the flashing lantern cap 300 is kept inside the head portion 400, not being shown from the outside.

Alternatively, as shown in FIG. 3*b*, the flashing lantern cap 300 may have the protrusion 33 at the opposite positions of the outer circumferential surface of the rear end of the flashing lantern cap 300. The protrusion 33 is inserted into the groove 44 so that the flashing lantern cap 300 and the head portion 400 can be coupled together.

Figure 5:
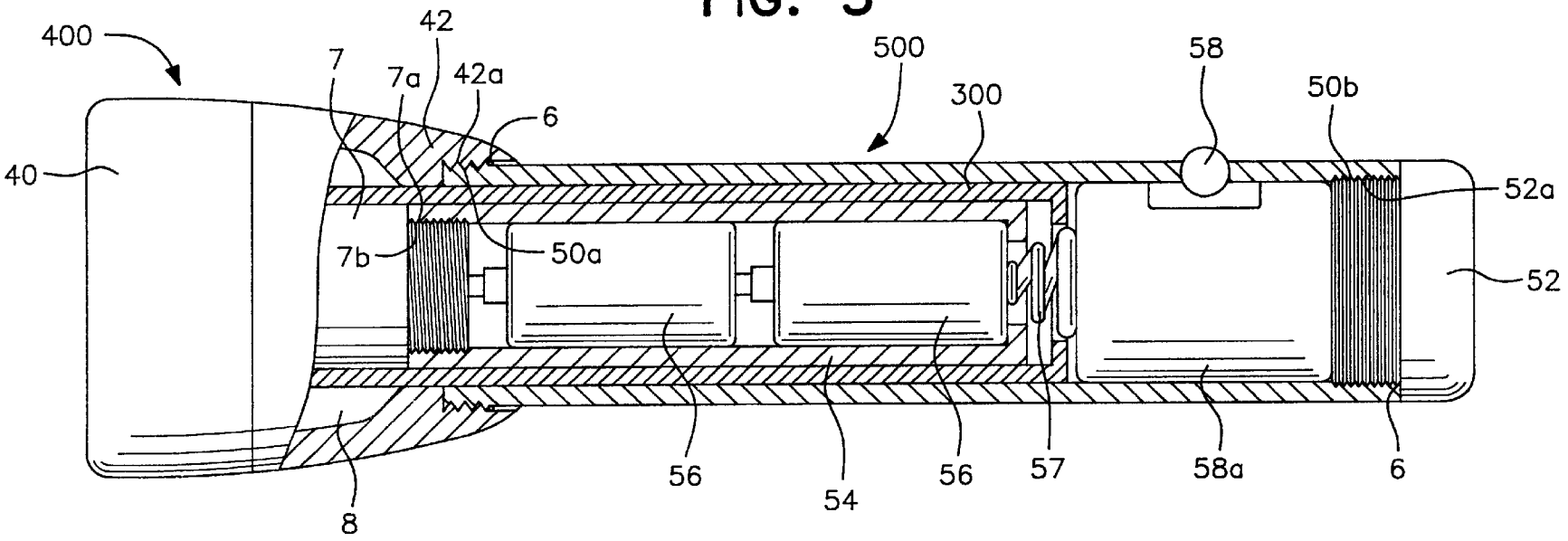
FIG. 5 is a sectional view showing a handle portion of the lantern of FIG. 2.

FIG. 5 shows the handle portion 500 of FIG. 2. Here, the flashing lantern cap 300 is longer than that of FIG. 4 and an auxiliary pipe 54 is used unlike the embodiment shown in FIG. 4.

A screw-threaded portion 42*a* formed on the inner circumferential surface of the rear end of the body portion 42 of FIG. 4 and a screw-threaded portion 50*a* formed on the outer circumferential surface of the handle portion 500 as shown in FIG. 5 are conjoined so that the handle portion 500 is coupled at the rear end of the head portion 400.

Here, since the O-ring 6 is provided between the screw-threaded portion 50*a* of the handle portion 500 and the screw-threaded portion, 42*a* of the head portion 400, external moisture or water is prevented from intruding into the inside thereof.

A rear cap 52 is provided at the read end of the handle portion 500 as a preferred embodiment of the present invention. The rear cap 52 having a screw-threaded portion 52*a* formed on the outer circumferential surface thereof is screw-coupled to a screw-threaded portion 50*b* formed on the inner circumferential surface of the rear end of the handle portion 500. Here, the O-ring 6 is provided between the screw-threaded portion 52*a* and 50*b* to prevent intrusion of the outside air and water. By inserting the inner circumferential surface of the auxiliary pipe 54 into the outer circumferential surface of the lamp socket 7, or by being coupled by screw-threaded portion 7*b* and 7*a* respectively formed on the outer circumferential surface of the rear end of the lamp socket 7 and the inner circumferential surface of the auxiliary pipe 54, the auxiliary pipe 54 is supported by the rear cap 52 or the lamp socket 7, the auxiliary pipe 54 containing a battery 56 can be stably supported inside the handle portion 50.

The power supplied from the battery 56 contained in the auxiliary pipe 54 is applied to the lamp 3 through the inside of the lamp socket 7 to turn on the lamp 3. Also, a spring 57 is provided between the fore end of the rear cap 52 and the battery 56 to stably supply power from the battery 56 by closely pressing the lamp socket 7 toward the lamp 3.

Also, the diameter of the auxiliary pipe 54 is constructed to be less than that of the handle portion 500 so that a space for inserting the flashing lantern cap 300 can be formed between the auxiliary pipe 54 and the handle portion 500. Therefore, The flashing lantern cap 300 formed to be rather long can be kept in the space formed inside a lantern, i.e, inside the handle portion 500.

Figure 6:
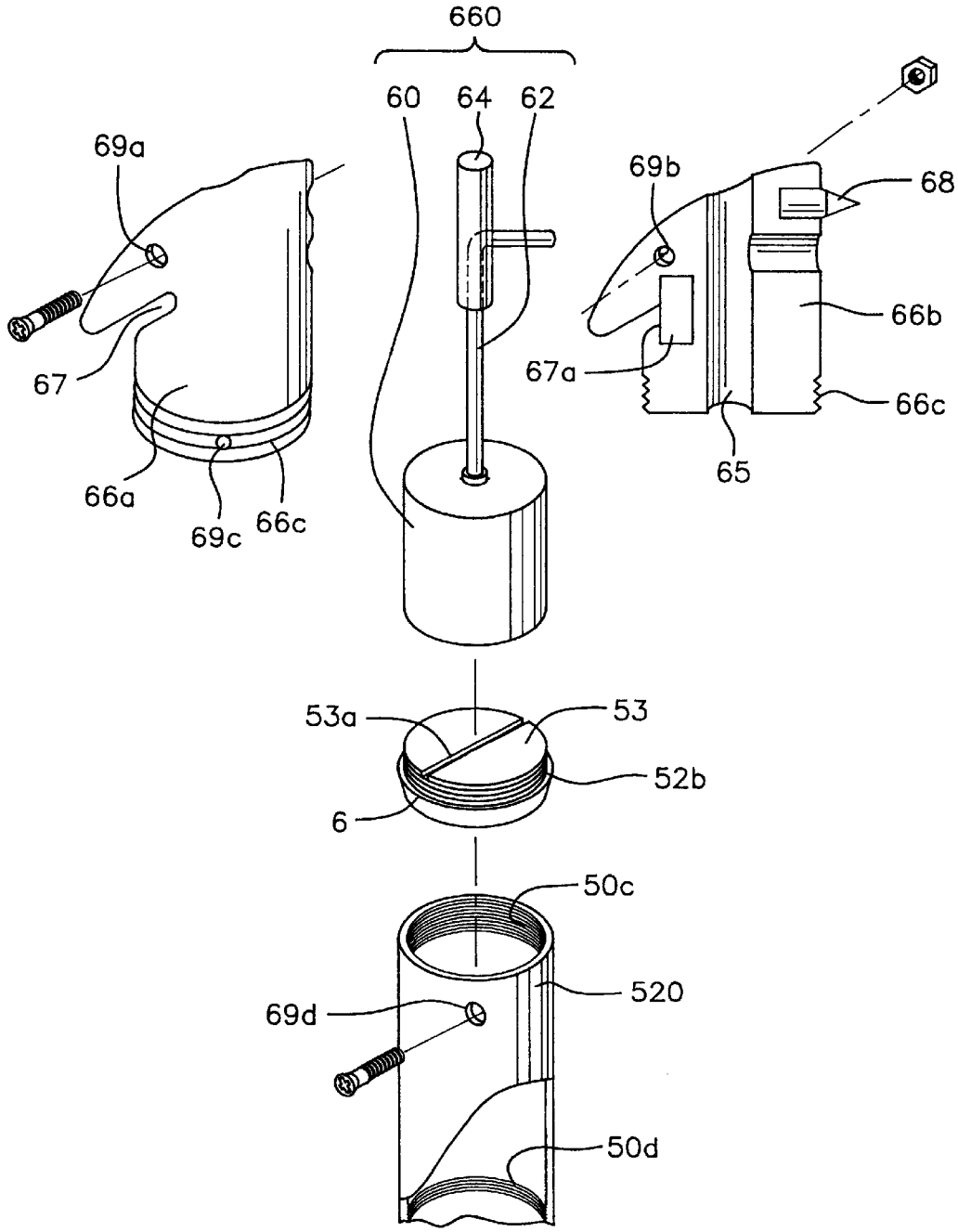
FIG. 6 is an exploded perspective view showing other functional portions of the lantern of FIG. 2.

FIG. 6 shows a multi-function portion 600 of FIG. 2, As shown in the drawing, the multi-function portion 600 provided as an alternative to the rear cap 52 includes a cuter 67*a*, a hammer 68, a compressed gas portion 660, and a pair of coupling pieces 66*a* and 66*b*. Here, the coupling pieces 66*a* and 66*b* are assembled to include the cutter 67*a*, the hammer 68, and the compressed gas portion 660 inside, although a portion of the compressed gas portion 660 is disposed inside the handle portion 320.

The handle portion 520 shown in FIG. 6 is different from the handle portion 500 of FIG. 5 in the structure of the rear end. That is, the handle portion 520 includes a first screw-threaded portion 50*c* and a second screw-threaded portion 50*d* respectively formed at the inner circumferential surfaces of the upper and lower portions thereof, as shown in FIG. 6. The separating cap 53 having the O-ring 6 and a screw-threaded portion 52*b* at the outer circumferential surface thereof and a slot 53*a* at one side surface thereof to be rotated by a screw driver is coupled to the second screw-threaded portion 50*d* of the handle portion 520.

The compressed gas portion 660 includes a button 64, an outlet pipe 62, and a compressed gas container 60. The compressed gas container 60, disposed between the separating cap 53 and the rear end of the handle portion 520, is filled with a compressed gas such as tear gas or pepper spray which can be used for self-defense by pressing down on the button 64 to eject the filled gas through the outlet pipe 62.

The outlet pipe 62 of the compressed gas container 60 is held between the coupling pieces 66*a* and 66*b* as they are assembled. That is, since a groove 65 is formed on each of the facing surfaces of the coupling pieces 66*a* and 66*b*, the outlet pipe 62 of the compressed gas container 60 is placed in the groove 65. The button 64 to press the outlet pipe 62 downward is provided at the bent portion of the outlet pipe 62. Here, the button 64 protrudes above the coupling pieces 66*a* and 66*b* assembled to facilitate a pressing operation Also,each of the coupling pieces 66*a* and 66*b* has a screw-threaded portation 66*c* so that the screw-threaded portion 66*c* is combined with the first screw-threaded potion 50*c* formed on the inner circumferential surface of the handle portion 520 as the assembled coupling pieces 66*a* and 66*b* are screw-coupled to the handle portion 520. Further, the screw-threaded portion 66*c* of the coupling pieces 66*a* and 66*b* has an O-ring so that the external moisture or water is prevented from intruding into the inside. In the lantern having a flashing lantern cap according to the present invention, since O-rings are used at every coupling points excluding the flashing lantern cap to prevent intrusion of moisture or water, a waterproof lantern can be manufactured.

An angled inlet 67 provided for safety is formed at one side of the coupling pieces 66*a* and 66*b*. A cutter 67*a* is provided at the angled inlet 67 as shown in FIG. 6. A hammer 68 formed of metallic material is provided at the opposite side of the angled inlet 67. Both the cuter 67*a* and the hammer 68 are fixed inside the coupling pieces 66*a* and 66*b* as they are assembled.

Also, screw holes 69*a*, 69*b*, and 69*c* are formed on the coupling pieces 66*a* and 66*b* and a screw hole 69*d* is formed on the handle portion 520, so that the coupling pieces can be assembled by screws. Here, the coupling pieces 66*a* and 66*b* are fixed to the handle portion 520 by the screw holes 69*c* and 69*d*. Since the head portion 400, the handle portion 500(520), and the multi-function portion 600, excluding the flashing lantern cap 300, is formed of metallic material, they altogether form a closed circuit so that an electrical current generated form the battery 56 flows therethrough Also, a switch 58 for turning the lamp 3 on and off is formed to protrude above the outer surface of the handle portion 520 at one side of a switch portion 58*a* including a switch mechanism. Also, it is obvious that, without the switch 58, the lamp 3 can be turned on and off by rotating the head portion 400, the handle portion 500(520), and the multi-function portion 600, each in an opposite direction, thereby making electrical contact between the respective portions to contact or separate from each other.

Figure 7:
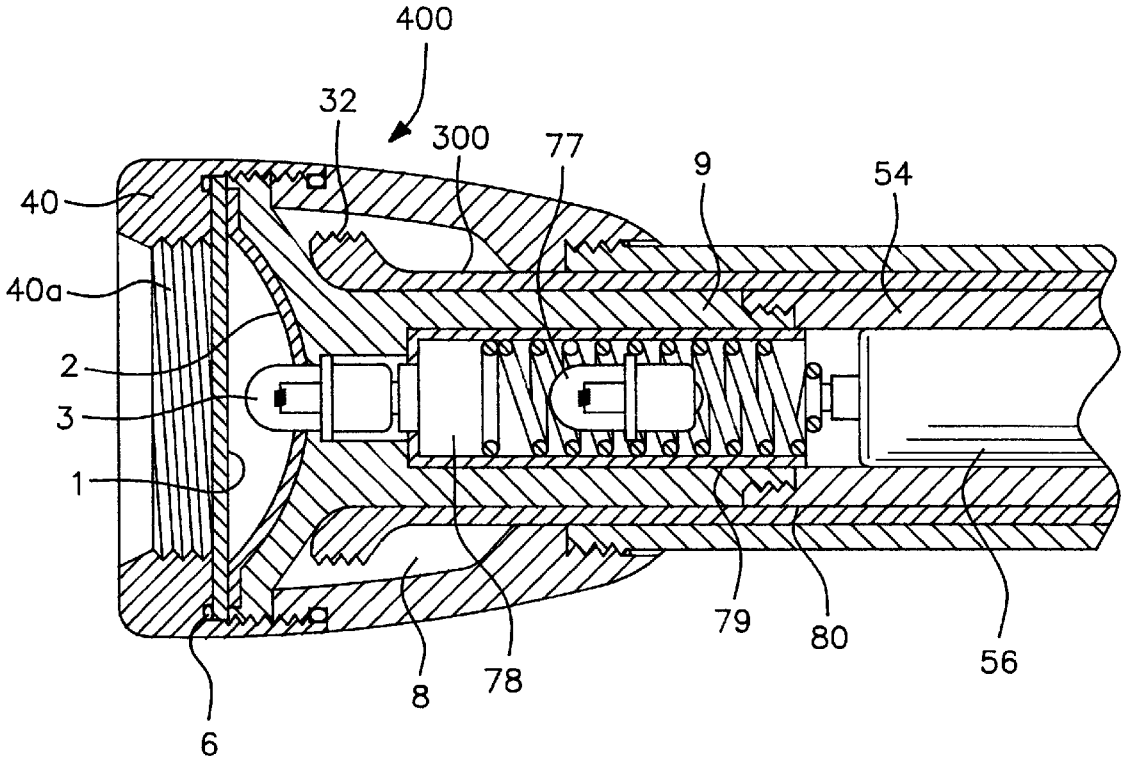
FIG. 7 is a sectional view showing the lamp socket of FIG. 2 according to another preferred embodiment of the present invention.

FIG. 7 shows another preferred embodiment of the lamp socket 7 of FIG. 2. As shown in the drawing, a lamp socket 9 includes a contact member 78, a spring 79, and an insulation pipe 80.

The contact member 78 contacts a power terminal of the lamp 3 to flow electricity The spring 79 applies a force to closely press the contact member 78 to the lamp and simultaneously applies electrical power from the battery 56 to the contact member 78. The insulation pipe 80 prevents the electricity flowing through the contact member 78 and the spring 79 from flowing through the lamp socket 7. Thus a preliminary lamp 77 can be stored and kept further in a space inside the spring 79 to be used when the lamp 3 goes out.

Figure 8A:
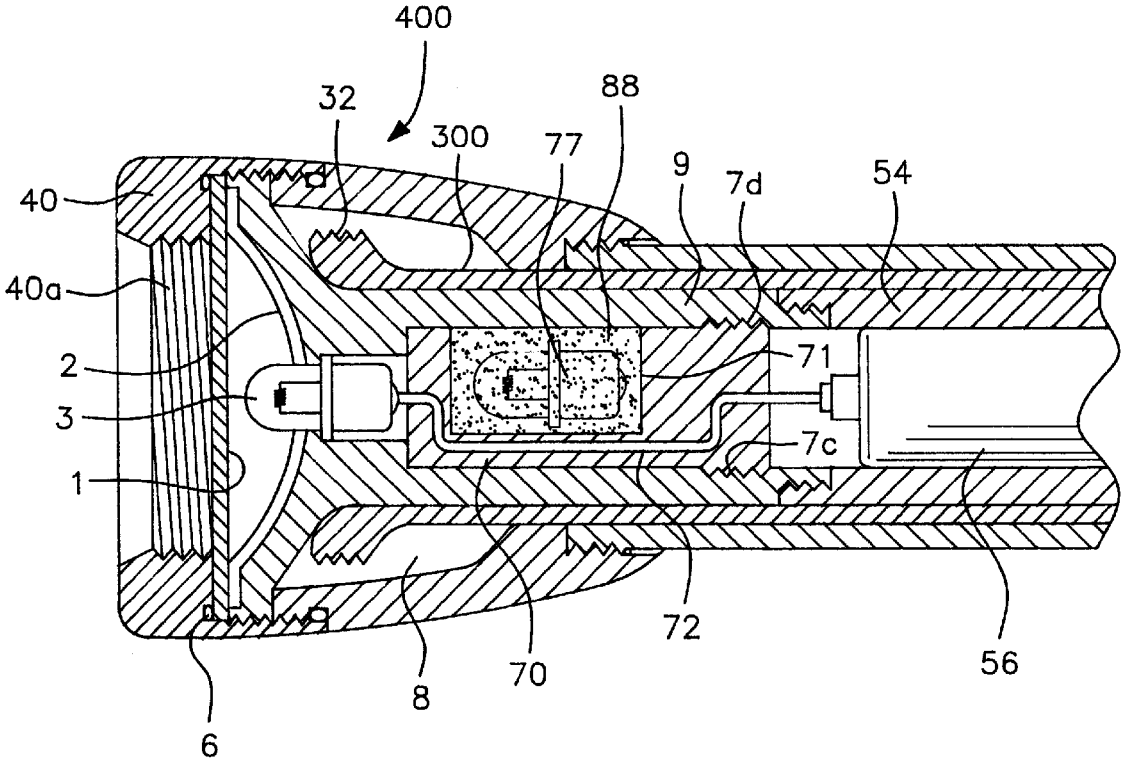
FIG. 8*a* is a sectional view showing the lamp socket of FIG. 2 according to yet another preferred embodiment of the present invention.

FIG. 8*a* shows yet another preferred embodiment of the lamp socket 7 of FIG. 2. As shown in the drawing, a storing cap 70 having an indentation portion 71 formed by cutting away a portion thereof is provided inside a lamp socket 9. The preliminary lamp 77 is stored in the indentation portion 71 by being wrapped in a wrapping member 88 such as a sponge or cotton.

Figure 8B:
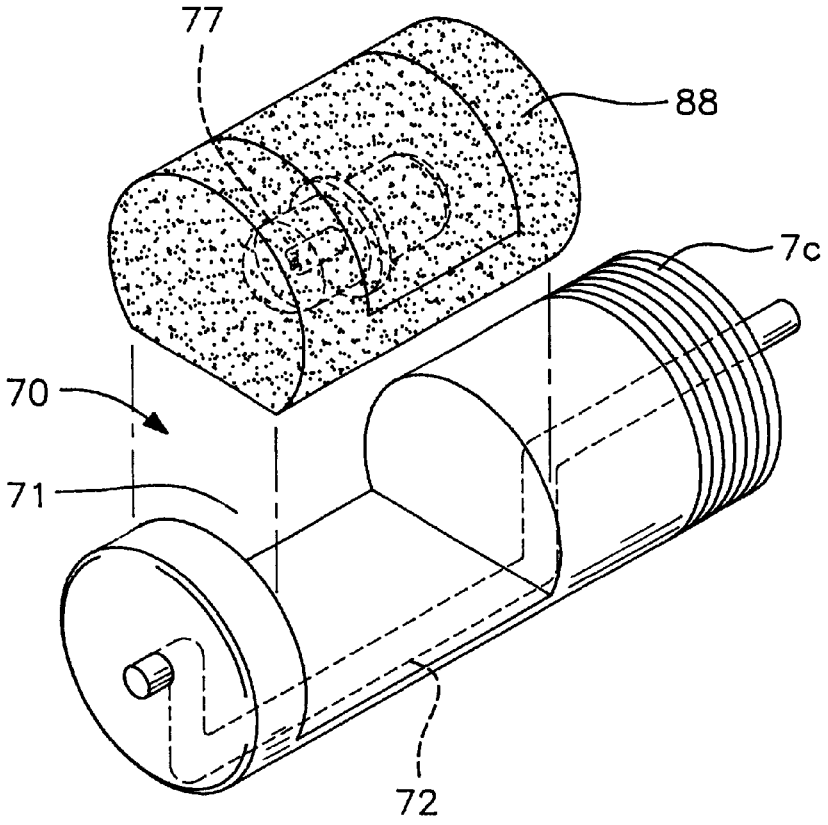
FIG. 8*b* is a perspective view showing the storing cap of FIG. 8*a*.

FIG. 8*b* shows the storing cap 70 of FIG. 8*a*. As shown in the drawing, the storing cap 70 has an electrically conductive member 72 passing through the inside thereof so that electrical power of the battery 56 is applied to the power terminal of the lamp 3. Also, the storing cap 70 is coupled to the lamp socket 9 by combining a screw-threaded portion 7*c* formed on the outer circumferential surface of the storing cap 70 and a screw-threaded portion 7*d* formed on the inner circumferential surface of the lamp socket 9.

Figure 9:
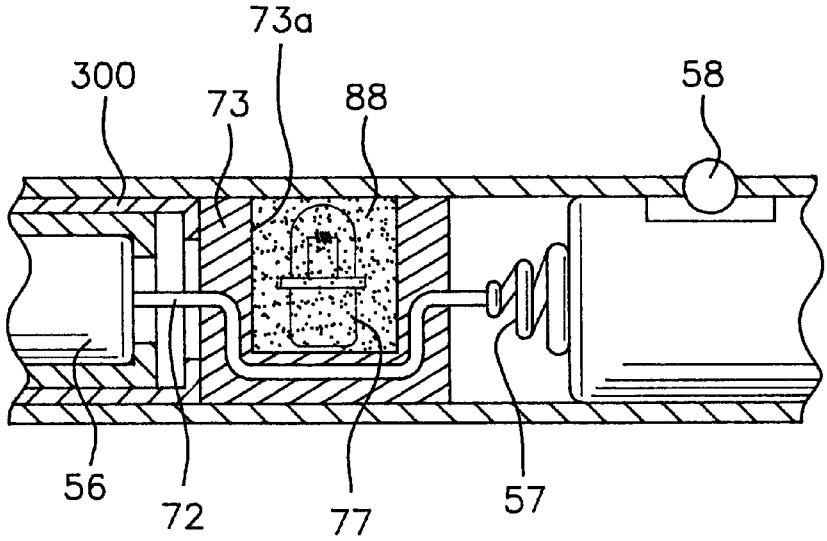
FIG. 9 is a sectional view showing the handle portion of FIG. 2 according to another preferred embodiment of the present invention.

FIG. 9 shows another preferred embodiment of the handle 500 of FIG. 2. As shown the drawing, the handle portion 500 includes a storing portion 73 between the auxiliary pipe 54 and the switch portion 58*a*. The storing portion 73 has, at one side thereof, an indentation portion 73*a* for storing the preliminary lamp 77 which is wrapped by the wrapping member 88 such as a sponge or cotton. A conductive member 72 for flowing electricity between the spring 57 and the battery 56 is provided inside the storing cap 73.

When the lantern of the present invention is provided in a vehicle, the cutter 67*a* can be used to cut the safety belt in an emergency situation such as a car accident and the hammer 68 can be used to break a window so that a person stuck inside the car can easily escape therefrom. Also the compressed gas portion 660 may be used as a self-defense apparatus when one is exposed to violence. The flashing lantern cap 300 is useful when a car accident occurs and it is needed to direct traffic at night.

It is noted that the present invention is not limited to the preferred embodiment described above, and it is apparent that variations and modifications by those skilled in the art can be effected within the spirit and scope of the present invention defined in the appended claims.

As described above, since the lantern according to the present invention includes the flashing lantern cap which is kept inside the lantern, a hammer for breaking a window and a cutter for cutting the safety belt in an emergency situation, and a compressed gas injector used for self-defense use, the lantern has various function as above in addition to the conventional function of providing light at night.

What is claimed is:

1. A lantern having a flashing lantern cap, comprising:

a cap portion having screw-threaded portions formed at the inner circumferential surface of front and rear ends thereof;

a lamp socket comprising a transparent window received in the cap portion and a reflection mirror of a hemisphere shape installed inside the transparent window, the lamp socket coupled to the inner circumferential surface of the cap portion, wherein a lamp is positioned at a center of the reflection mirror;

a body portion screw-coupled to the inner circumferential surface of the rear end of the cap portion, the body portion for keeping the lamp socket therein;

a handle portion for accommodating a battery therein, the handle portion being screw-coupled to the body portion at an outer circumference of a front end of the handle portion;

a flashing lantern cap of a pipe shape having a screw-threaded portion protruding from an outer circumferential surface of a rear end thereof to be coupled to the screw-threaded portion at the inner circumferential surface of the front end of the cap portion, the flashing lantern cap having a hole at a front end thereof, the flashing lantern cap being kept inside the handle portion such that the screw-threaded portion at the outer circumferential surface of the rear end of the flashing lantern cap is kept inside the body portion when it is not used.

2. The lantern of claim 1, wherein a multi-function portion is provided at the rear end of said handle portion, the multi-function portion comprises a cutter provided in the angled inled, and a hammer formed of metallic material at an opposite site of the angled inlet; the angled inlet is formed at one side of two coupling pieces, Both the cutter and the hammer are fixed inside the coupling pieces as they are assembled.

3. The lantern of claim 1, wherein the handle portion further comprises an auxiliary pipe for stably containing batteries within said flashing lantern cap.

4. The lantern of claim 3, wherein said auxiliary pipe is supported by a screw-threaded portion formed at said auxiliary pipe and a screw-threaded portion formed at said lamp socket, which are joined together.

5. The lantern of claim 1, wherein a preliminary lamp is stored inside said lamp socket, and wherein a storing cap having an indentation portion formed at one side thereof is provided inside said lamp socket so that said preliminary lamp is stored in said indentation portion by being wrapped in a wrapping member and the storing cap has a conductive member through which electricity flows between said lamp and a battery.

6. The lantern of claim 1, wherein a preliminary lamp is stored inside said lamp socket, and wherein said lamp socket comprises a contact member contacting a power terminal of said lamp;

a spring applying a force to closely press said contact member onto said lamp and power supplied from a battery to said contact member, and an insulation pipe having said contact member and said spring therein for preventing electricity flowing through said contact member and said spring from flowing to said lamp socket, so that said preliminary lamp is stored in a space formed inside said spring.

7. The lantern of claim 1, wherein said handle portion stores a preliminary lamp.

8. A lantern having a flashing lantern cap, comprising:

a cap portion having screw-threaded portions formed at the inner circumferential surface of front and rear ends thereof;

a lamp socket comprising a transparent window received in the cap portion and a reflection mirror of a hemisphere shape installed inside the transparent window, the lamp socket coupled to the inner circumferential surface of the cap portion, wherein a lamp is positioned at a center of the reflection mirror;

a body portion screw-coupled to the inner circumferential surface of the rear end of the cap portion, the body portion for keeping the lamp socket therein;

a handle portion for accommodating a battery therein, the handle portion being screw-coupled to the body portion at an outer circumference of a front end of the handle portion;

wherein a handle portion comprises a switch which is provided at the rear portion of the rear portion of the handle to be exposed to the outside;

a flashing lantern cap of a pipe shape having a screw-threaded portion protruding from an outer circumferential surface of a rear end thereof to be coupled to the screw-threaded portion at the inner circumferential surface of the front end of the cap portion, the flashing lantern cap having a hole at a front end thereof, the flashing lantern cap being kept inside the handle portion such that the screw-threaded portion at the outer circumferential surface of the rear end of the flashing lantern cap is kept inside the body portion when it is not used.

9. The lantern of claim 8, wherein a multi-function portion is provided at the rear end of said handle portion, the multi-function portion comprises a cutter provided in the angled inlet, and a hammer formed of metallic material at an opposite site of the angled inlet; the angled inlet is formed at one side of two coupling pieces, both the cutter and the hammer are fixed inside the coupling pieces as they are assembled.

10. The lantern of claim 8, wherein the handle portion further comprises an auxiliary pipe for stably containing batteries within said flashing lantern cap.

11. The lantern of claim 10, wherein said auxiliary pipe is supported by a screw-threaded portion formed at said auxiliary pipe and a screw-threaded portion formed at said lamp socket, which are joined together.

12. The lantern of claim 8, wherein a preliminary lamp is stored inside said lamp socket, and wherein a storing cap having an indentation portion formed at one side thereof is provided inside said lamp socket so that said preliminary lamp is stored in said indentation portion by being wrapped in a wrapping member and the storing cap has a conductive member through which electricity flows between said lamp and a battery.

13. The lantern of claim 8, wherein a preliminary lamp is stored inside said lamp socket, and wherein said lamp socket comprises a contact member contacting a power terminal of said lamp;

a spring applying a force to closely press said contact member onto said lamp and power supplied from a battery to said contact member, and an insulation pipe having said contact member and said spring therein for preventing electricity flowing through said contact member and said spring from flowing to said lamp socket, so that said preliminary lamp is stored in a space formed inside said spring.

14. The lantern of claim 8, wherein said handle portion stores a preliminary lamp, wherein a storing portion is provided inside said handle portion between an auxiliary pipe and a switch portion; said preliminary lamp is stored in said storing portion by being wrapped in a wrapping member.

* * * * *